US005697107A

United States Patent [19]

Takimoto

[11] Patent Number: 5,697,107

[45] Date of Patent: *Dec. 16, 1997

[54] FASHION BELT

[76] Inventor: Kiyotaka Takimoto, 1001-212, Nishiterakata-machi, Hachioji-shi, Tokyo, Japan

[ * ] Notice: The term of this patent shall not extend beyond the expiration date of Pat. No. 5,491,845.

[21] Appl. No.: 583,507

[22] Filed: Jan. 5, 1996

Related U.S. Application Data

[62] Division of Ser. No. 295,549, Aug. 25, 1994, Pat. No. 5,491,845.

[30] Foreign Application Priority Data

Sep. 22, 1993 [JP] Japan ..... 5-257560

[51] Int. Cl.[6] ..... A41F 9/00; A44B 11/00

[52] U.S. Cl. ..... 2/338; 24/68 J; 24/71 J

[58] Field of Search ..... 2/338, 311, 321, 2/322; 24/633, 585, 584, 582, 68 J, 71 J

[56] References Cited

U.S. PATENT DOCUMENTS

| | | | |
|---|---|---|---|
| D. 213,972 | 4/1969 | Anderson et al. . | |
| D. 253,258 | 10/1979 | Clark . | |
| 784,224 | 3/1905 | Peirce | 24/585 |
| 1,213,109 | 1/1917 | Kilstrom | 24/585 |
| 1,439,812 | 12/1922 | Goodrich | 24/585 |
| 1,483,853 | 2/1924 | Schwerd | 24/585 X |
| 1,590,063 | 6/1926 | Schillerstrom . | |
| 1,907,779 | 5/1933 | Freysinger | 24/581 |
| 2,035,671 | 3/1936 | Sawer | 2/338 X |
| 2,138,542 | 11/1938 | Goldberg | 24/581 |
| 3,171,409 | 3/1965 | Cetrone . | |
| 3,267,545 | 8/1966 | Eckart | 24/585 |
| 4,425,689 | 1/1984 | Fildan | 24/633 X |
| 4,450,992 | 5/1984 | Casull . | |
| 4,521,940 | 6/1985 | Oetiker . | |
| 4,727,630 | 3/1988 | Alan . | |
| 4,797,984 | 1/1989 | Seto et al. . | |
| 4,827,796 | 5/1989 | Horian | 24/584 |
| 4,875,299 | 10/1989 | Mabboux et al. | 24/585 X |
| 5,152,013 | 10/1992 | Johnson . | |
| 5,184,352 | 2/1993 | Maufette . | |
| 5,219,423 | 6/1993 | Kamaya | 24/633 X |
| 5,267,679 | 12/1993 | Kamaya et al. | 24/585 X |
| 5,427,562 | 6/1995 | Hwang | 24/585 X |
| 5,490,685 | 2/1996 | Kitayama et al. | 24/585 X |

*Primary Examiner*—C. D. Crowder
*Assistant Examiner*—Shirra L. Jenkins
*Attorney, Agent, or Firm*—Armstrong, Westerman, Hattori, McLeland & Naughton

[57] ABSTRACT

A fashion belt is provided which is capable of being formed variously out of various kinds of materials to various cross-sectional shapes. The fashion belt is capable of being tightened and loosened. The fashion belt includes a belt body and a buckle, the belt body being provided at one end portion with a fixing member and at the other end portion with locking bores, and the buckle being provided with a locking portion having an end to be fixed with the fixing member, and an opposing end capable of accepting the belt body, after insertion, in order to lock and unlock the belt body in an arbitrary position of insertion. The fixing member is provided with locking projections which are to be fixed by locking with locking bores of the buckle. The buckle has a rectangular cross-section and first and second ends having first and second openings, respectively. The second opening is provided with a locking portion which is to matingly lock with the locking bores of the belt body. Both sides of the locking portion are each provided with an operating member to unlock the lock of the belt body with the buckle.

12 Claims, 3 Drawing Sheets

FASHION BELT

BACKGROUND OF THE INVENTION

1. Field of the Invention

This application is a division of U.S. patent application Ser. No. 08/295,549, filed Aug. 25, 1994, now U.S. Pat. No. 5,491,845, and the invention relates to a fashion belt capable of being attached to or detached from a belt of various cross-sectional shapes.

2. Description of the Prior Art

Among the articles in which men and women are dressed, a belt is not only used only for tightening and fixing clothes, but in recent years, it is also been used widely as a decorative article as well. The kind of belt now in use is usually formed to a suitable width out of a skin of various kinds of animals, such as oxhide, or out of various kinds of hard resins, such as vinyl chloride. The cross-sectional shape of such a belt may be restricted by these materials, and such a belt in use usually has a flat cross-sectional shape. Most of the buckles act to connect both end portions of the belt and have a structure suitable for the cross-sectional shape of the belt, i.e., suitable for fixing a flat belt.

Most of the conventional belts described above have a flat cross-sectional shape, so that buckles for connecting both end portions of the belt have a structure suitable for the cross-sectionally flat belts. Therefore, the unavailability of a suitable belt-end-connecting member has constituted one of the causes of preventing the spread of various kinds of three-dimensional belts as fashion belts the improvement of the decorativeness of which has been pursued in recent years.

In order to improve, especially, the decorativeness of a belt, it has been demanded in many cases that materials having a very high degree of unevenness of the surfaces thereof, such as the skins of a crocodile or a big lizard and a braid be used. However, in order to form an integral belt for men's trousers and women's skirts and one-piece recess, without spoiling the characteristics of the uneven surfaces of these materials, it is necessary that both end portions of a belt of such a material be formed so as to have a flat cross-sectional shape for fitting these end portions in both end-connecting members properly since most of the end-connecting members are formed so that they suit flat belts. To meet this purpose, a high degree of difficulty, belt manufacturing techniques are required. Moreover, since the strength of such flattened end portions decreases greatly, it is difficult to use such materials for manufacturing a fashion belt, and this has prevented an extensive spread of a fashion belt.

SUMMARY OF THE INVENTION

Therefore, the present invention aims at providing a fashion belt capable of being formed variously out of various kinds of materials to various cross-sectional shapes, and tightened and loosened easily.

To solve the above-mentioned problems, the present invention provides a fashion belt including a belt body and a buckle, the belt body being provided at one end portion with a fixing member and at the other end portion with locking bores, and said buckle being provided with a locking portion, which locking portion has an end fixed with said fixing member, and the other end to be subjected to insertion of the belt body, then to lock and unlock, in an arbitrary position of insertion, which fashion belt being characterized in that the fixing member is provided with locking projections which is to be fixed by locking with locking recesses of the buckle, and the buckle has a shape of a rectangular cross section, has at both ends a first opening and a second opening, the end of which second opening is provided with a locking portion which is to lock with the locking recesses of the belt body, and has both sides provided with an operating member to unlock said lock of said belt body with the buckle.

In this invention constructed above, the fashion belt is tightened by inserting a free end portion of the belt into a buckle to which the other end portion of the belt is fastened, regulating the belt to a suitable tightening length, and putting the locking member in an engaged state so as to fix the belt in an arbitrary tightened state. The fashion belt is removed by unlocking the lock of the belt body with the buckle by operating the operating members provided at both sides walls of the buckle, and this fashion belt is capable of being formed variously out of various kinds of materials to various cross-sectional shapes, and tightened and loosened easily.

BRIEF DESCRIPTION OF THE DRAWINGS

FIG. 6(*b*) is a cross-sectional view of a belt body having a semicylindrical cross-sectional shape S.

FIG. 6(*c*) is a cross-sectional view of a belt body having a semicylindrical groove in the cross-sectional shape S thereof.

FIG. 6(*d*) is a cross-sectional view of a belt body having a triangular groove in the cross-sectional shape S thereof.

FIG. 6(*e*) is a cross-sectional view of a belt body made of a plurality of fibers, an aggregate of threads or thin strings and braids.

FIG. 6(*f*) is a cross-sectional view of a belt body made of a material consisting of a plurality of thick strings B arranged side by side and a base strip C bonded to the rear side of the strings B.

DESCRIPTION OF THE PREFERRED EMBODIMENT

The embodiments of the present invention will now be described with reference to the drawings.

A belt 1 has a three-dimensional belt body of a predetermined cross-sectional shape which consists of a shape retaining member 2 of a soft sponge, for example, vinyl chloride sponge and urethane sponge, and a base strip 3 of, for example, polyethylene which easily gets fit to a trunk of a human body while the belt is in use, and which has a sufficiently high tensile strength, is pasted on a rear surface of the shape retaining member 2. A covering sheet 4 consisting of a film of a soft synthetic resin, for example, vinyl chloride and urethane rubber or a cloth is pasted on a front part of the outer circumferential surface of the shape retaining member 2 so as to cover the same therewith.

Figure 1A:
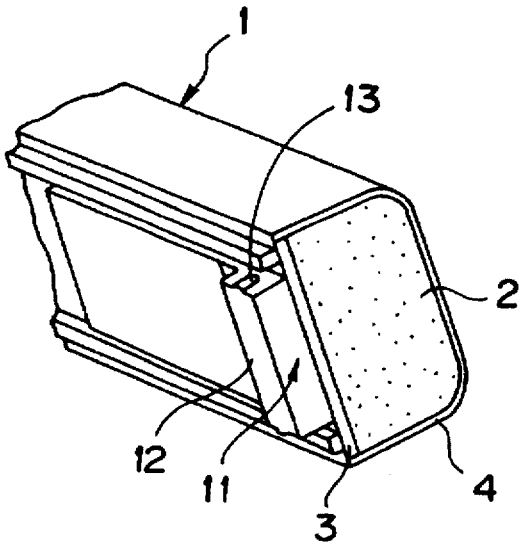
FIG. 1(*a*) is a perspective view of a belt end portion provided with a fixing member, and (*b*) is a perspective view of the other belt end portion, each taken from a rear side thereof.
Figure 1B:
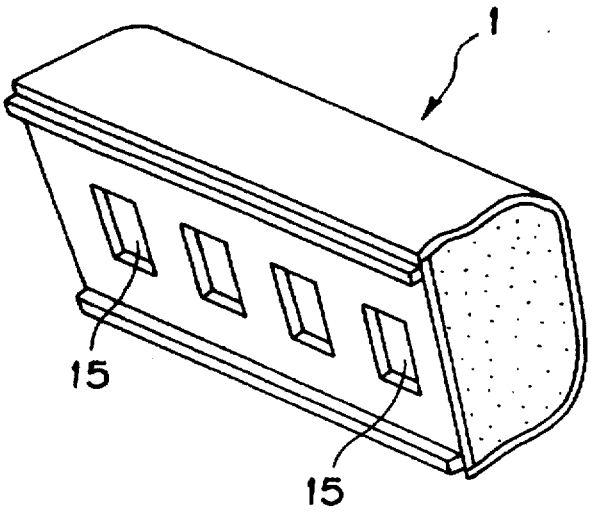

A fixing member 11, as shown in FIG. 1(*a*), to fix to a first end portion of the belt 1, is provided at one end portion of the belt thus formed. The fixing member 11 is provided with a fixing projection 12, at both sides of which locking projections 13 are provided. As shown in FIG. 1(*b*), at a second end portion of the belt 1, a base strip 3 bonded on the rear side thereof is provided with a plurality of locking bores in the lengthwise direction of the belt. The bores 15 may be formed together with the belt 1.

Figure 2:
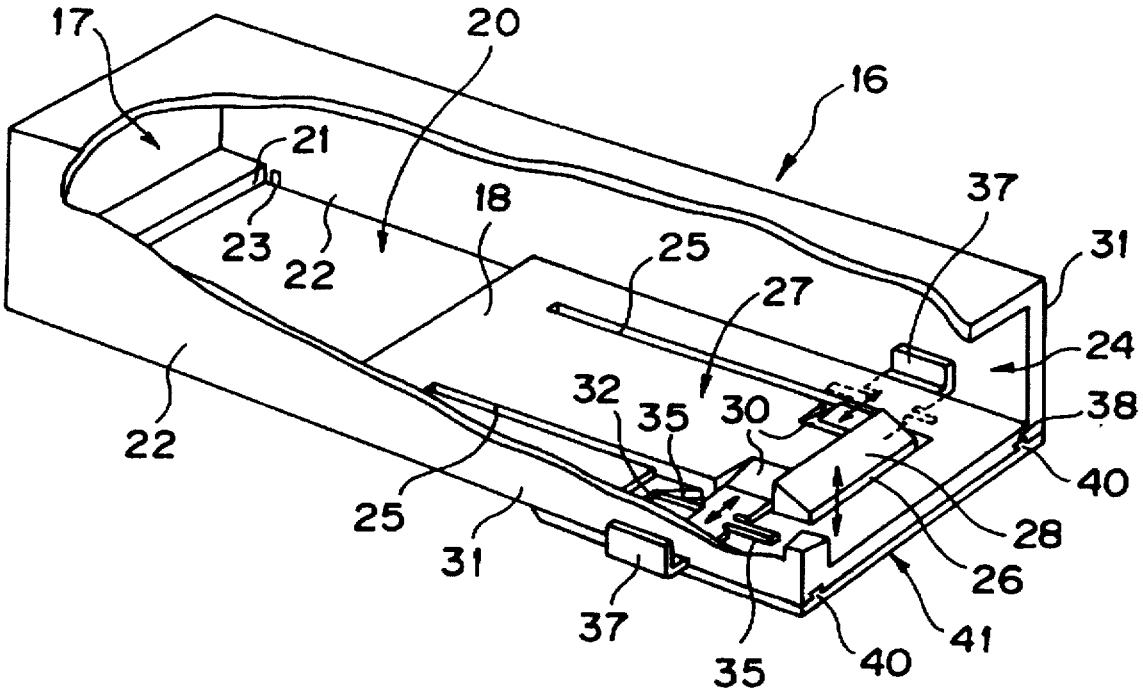
FIG. 2 is a partially cutaway view in perspective of a buckle in the embodiment of the present invention.
Figure 3:
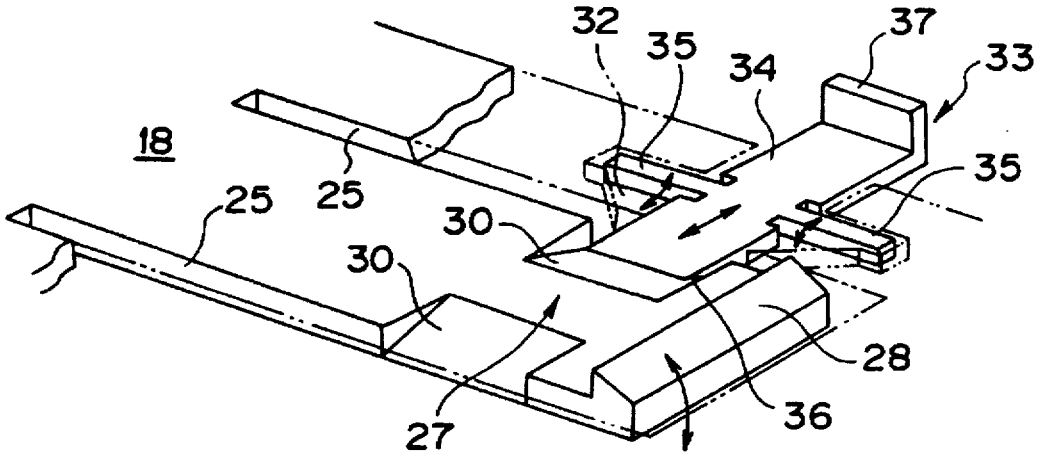
FIG. 3 is a perspective view of a principal portion of the same buckle.

As shown FIGS. 2 and 3, a buckle 16 has a hollow substantially rectangular cross section, having opposing top (shown partially cut away) and bottom walls (i.e., end wall 21, bottom plate 18 and covering plate 41 and an end portion of the belt 1 to which the fixing member 11 is fastened, is inserted into a first opening of the buckle. An end wall 21 is perpendicularly adjacent a third an opening 20 formed in a bottom plate 18 of the buckle and the fixing projection 12 then engage each other with the locking projections 13 on both sides of the fixing projection engaging locking recesses 23 provided in side wall 22 of the opening, the fixing member 11 being thus fastened to the first opening 17 of the buckle.

The side of a second opening 24 of the buckle is provided with a locking member 27 defined by two side slits 25 and a recess 26 connecting these slits 25 together. This locking member 27 is provided at its free portion with an inclined surface lowering gradually toward the second opening 24, and a vertical surface-carrying locking portion 28 on the rear side of the inclined surface. This locking member 27 is further provided at both sides of the free end portion thereof with guide surfaces 30 which becomes lower from the central portion of the locking member toward both side portions thereof.

Figure 4:
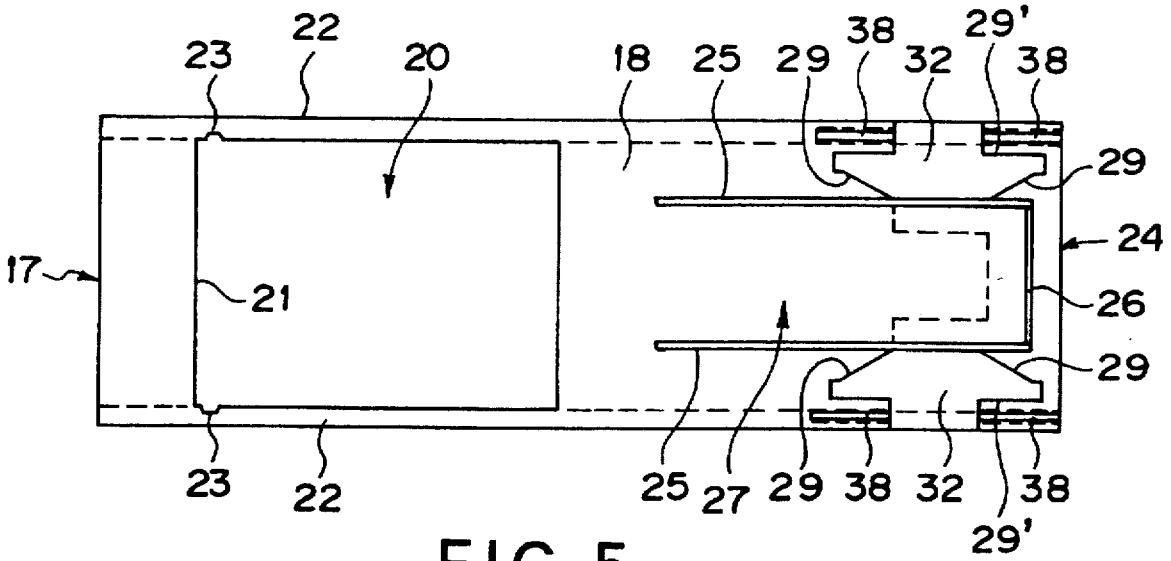
FIG. 4 is a rear plan view of the same buckle.
Figure 5:
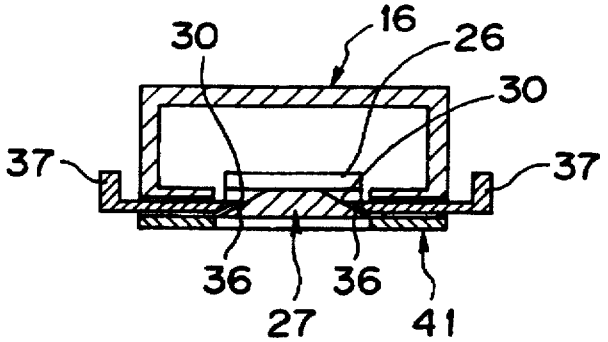
FIG. 5 is a sectional plan view of the same buckle.
Figure 6A:
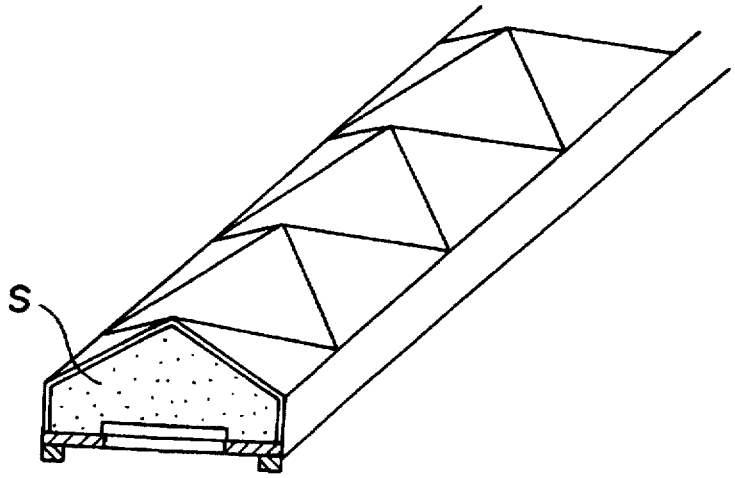
FIG. 6(*a*) is a perspective view of an example of a belt body used in the present invention, wherein the belt body has a cross-sectional shape S that is somewhat house-shaped.
Figure 6B:
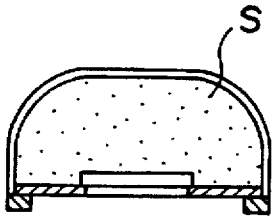
Figure 6C:
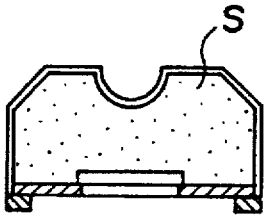
Figure 6D:
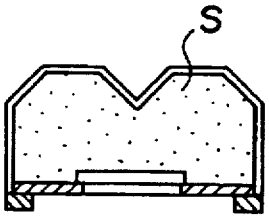
Figure 6E:
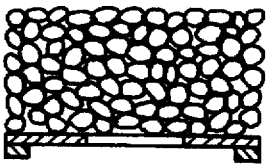
Figure 6F:
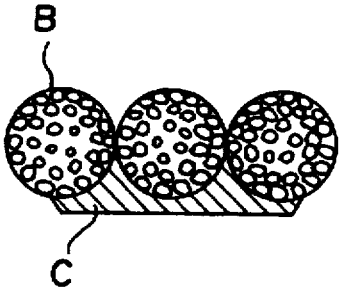

The portions of a rear surface of the bottom plate 18 which correspond to the guide surfaces 30 are provided with operating member-holding recesses 32 each of which consists, as shown in FIG. 4, of a substantially wing-shaped recess 29 extending from a substantially central portion toward the surface of the relative slit 25, and a recess having parallel side surfaces 29' extending from the wing-shaped recess 29 toward the relative side surface 31 of the buckle 16. Because of this construction, the operating member-holding recesses 32 is in an opened state on the rear side of the buckle 16.

In each of these operating member-holding recesses 32, an operating member 33 shown in FIG. 3, is held. This operating member 33 has resilient rods 35 projecting from the substantially central portion of a central operating plate 34 in the opposite lateral directions, and a locking member pressing portion 36 at the front side of the resilient rods, which pressing portion 36 has a shape and an angle of inclination in accordance with those of the relative guide surface 30 of the locking member 27, the operating plate 34 being provided at an outer end portion thereof with a vertically projecting pressing member 37.

In the portions of the rear surface of the bottom plate 18 of the buckle 16 which are in the vicinity of the operating member-holding recesses 32, dovetail grooves 38 are formed so as to extend in the lengthwise direction of the belt, and covering plate 41, having projections 40 engageable with the dovetail grooves 38 and projecting from one surface of the plate 41, is put over the rear surface of the operating members 33 after the operating members 33 have been held in the operating member-holding recesses 32. The projections 40 are engaged with the dovetail grooves 38 to fix the covering plate 41, whereby the operating members 33 are held operably in the operating member-holding recesses 32.

In order to use this fashion belt, the fixing member 11 is fastened to the first opening 17 of the buckle 16, and a free end portion of the belt 10 is then inserted into the second opening 24 thereof. During this time, the locking portion 28 of the locking member 27 is pressed at the inclined surface of a free end part thereof, so that the locking portion 28 gets over the locking bores 15 sequentially with a free end portion of the belt inserted gradually into the inner portion of the buckle 16. When the insertion is stopped in a suitable belt tightening position, the locking portion 28 enters a locking bore 15 and is locked up therein because of the vertical surface of the locking portion 28, so that the disengagement of the locking portion 28 is prevented.

In order to loosen the belt, the pressing members 37 which project from both side surfaces 31 of the buckle of the operating members 33 are pressed by the thumb and finger, so that the free end portions of the resilient rods 35 of the operating members 33 are supported on both side portions of the wing-shaped recesses of the operating member-holding recesses 32, whereby the movement of the resilient rods is prevented. When the operating members 33 are pushed against the resiliency of the resilient rods 35, the locking member pressing portions 36 enter the guide surfaces 30 of the locking member 27 as the former are guided by the latter, and the locking member 27 is pressed down due to the effects of the inclined surfaces of the locking member 27 and guide surfaces 30. Consequently, the locking portion 28 at the free end of the locking member 27 retracts and disengages from the locking bore 15 in the belt 1, and the free end portion of the belt 1 is put in a free state and becomes ready to be withdrawn from the buckle 16, i.e., the fashion belt can be removed.

The present invention is not limited to the above-mentioned embodiments. Various other modifications which can be effected by those skilled in the art within the scope of the construction defined by the claims, are of course, included in the invention.

The above embodiment illustrates a belt 1 having a shape of a substantially, cross-sectional rectangle, for example, belts having various cross-sectional shapes shown in FIG. 6 can also be employed. Namely, a belt having the cross-sectional shapes of which varies in the lengthwise direction thereof as shown in FIG. 6(*a*), a belt having a semicylindrical cross section as shown in FIG. 6(*b*), a belt having a semicylindrical groove in the front surface thereof as shown in FIG. 6(*c*), and a belt having a cross-sectionally triangular groove in the front surface thereof as shown in FIG. 6(*d*) may also be employed. Various materials other than that referred to in the description of the above embodiment may be used for the belt 1. Namely, a bundle or a plurality of fibers, an aggregate of threads or thin strings, and braids shown in FIG. 6(*e*), and a material consisting of a plurality of thick strings B arranged side by side and a base strip C bonded to the rear side of the strings B, which is shown in FIG. 6(*f*), may be also used. Furthermore as a locking member between the buckle and the inserting member, in addition to the above embodiment, various kinds of prior art locking means known can be employed. Also, a surface plate as a core band may be provided through the full length of the thick string and a reinforcing material may be provided on the surface plate side.

Since the present invention is constructed and operated as described above, the three-dimensional belt having various cross-sectional shapes can be used as a fashion belt, and the skin of a crocodile or a big lizard which has heretofore been difficult to use for this kind of belts can now be used easily. Moreover, braids can also be used for fashion belts. This enables the decorativeness of a belt to be improved. The tightening and loosening of such a belt can be easily accomplished because of the convenience, this fashion belt can be used widely.

A plurality of locking members are provided in a belt, so that the belt tightening length regulating members can be operated stably, and the belt engaging, disengaging and tightening operations can be carried out stably.

What is claimed is:

1. A fashion belt comprising:

a belt body having first and second end portions with a fixing member at said first end portion and locking bores at said second end portion, wherein said fixing member has a fixing projection with locking projections extending outwardly from opposing sides of said fixing projection; and a buckle being an approximately hollow, rectangular, open-ended block having a rectangular cross-section, opposing top and bottom walls, opposing side walls and opposing first and second ends, wherein said first end has a first opening therein and said second end has a second opening therein, said bottom wall includes an end wall perpendicularly adjacent said first opening, a bottom plate with a locking member perpendicularly adjacent said second opening and a third opening between said end wall and said bottom plate, said side walls of said buckle have locking recesses near said first end thereof for engagement with said locking projections of said fixing member of said belt body, said first opening is for insertion of said belt body therein so as to lock and unlock said belt body in an arbitrary position of insertion within said buckle, said locking member has a locking portion for engagement with said locking bores of said belt body, and said locking member has first and second sides each provided with an operating means for unlocking said belt body from said buckle.

2. The fashion belt according to claim 1, wherein said second end of said buckle is also provided with a locking member defined by slits on both first and second sides of said buckle and a recess connecting said slits together at said second opening.

3. The fashion belt according to claim 2, wherein said locking member has an end portion with an inclined surface that gradually lowers toward said second opening, a vertical surface having locking portions at an inner part thereof, and a free end portion having two sides each with guide surfaces which decline from a central portion of said locking member toward both opposed side portions thereof.

4. The fashion belt according to claim 3, wherein portions of a rear surface of said bottom plate of said buckle which correspond to said guide surfaces are provided with operating member-holding recesses, wherein each of said operating member-holding recess consists of a substantially wing-shaped recess extending from a substantially central portion of said substantially wing-shaped recess toward a surface of said slit, and a recess having parallel side surfaces extending from said substantially wing-shaped recess toward a side surface of said buckle.

5. The fashion belt according to claim 4, wherein said operating member has resilient rods projecting from a substantially central portion of a central operating plate in opposite lateral directions, and a locking member pressing portion at a front side of said resilient rods.

6. The fashion belt according to claim 1, wherein said belt comprises a plurality of strings.

7. The fashion belt according to claim 1, wherein said belt has a varied cross section.

8. The fashion belt according to claim 1, wherein said belt has a semi-cylindrical form.

9. The fashion belt according to claim 1, wherein said belt has a cross-sectionally semi-cylindrical groove in a front surface thereof.

10. The fashion belt according to claim 1, wherein said belt has a cross-sectionally triangular groove in a front surface thereof.

11. The fashion belt according to claim 1, wherein said belt is composed of a bundle of a plurality of fibers.

12. The fashion belt according to claim 1, wherein said belt comprises a synthetic resin.

* * * * *